United States Patent [19]

Riester

[11] 3,941,868

[45] Mar. 2, 1976

[54] METHOD OF REMOVING EXHAUST GASES FROM PLASTIC BINDED SAND MOLDS

[75] Inventor: Hans Riester, Schaffhausen, Switzerland

[73] Assignee: Georg Fischer Aktiengesellschaft, Switzerland

[22] Filed: Feb. 21, 1974

[21] Appl. No.: 444,693

[30] Foreign Application Priority Data

Feb. 24, 1973 Switzerland ..... 2635/73

[52] U.S. Cl. ..... 423/210; 164/76; 423/224; 423/245

[51] Int. Cl.[2] ..... B01D 47/00

[58] Field of Search ..... 423/210, 224, 245; 431/5, 431/12; 164/76

[56] References Cited

UNITED STATES PATENTS

| | | | |
|---|---|---|---|
| 3,545,918 | 12/1970 | Frundl | 423/210 |
| 3,637,343 | 1/1972 | Hirt | 423/210 |
| 3,804,079 | 4/1974 | Schrader | 423/210 X |
| 3,806,322 | 4/1974 | Tabak | 431/5 X |
| 3,838,974 | 10/1974 | Hemsath | 423/210 |

*Primary Examiner*—L. Dewayne Rutledge
*Assistant Examiner*—Arthur J. Steiner
*Attorney, Agent, or Firm*—Toren, McGeady and Stanger

[57] ABSTRACT

In casting operations using molds made of plastic-bonded sands, the exhaust gases generated from the plastic binder are collected within an enclosure to which the mold passes from a casting location, the gases are mixed with combustion air supplied into the enclosure and an ignition source is arranged within the enclosure to ignite the combined exhaust gases and combustion air. The enclosure is insulated to retain the heat generated in the combustion operation. An outlet is provided from the enclosure so that any unburnt gases remaining from the exhaust gases can be collected and harmful substances removed to avoid any pollution of the atmosphere.

4 Claims, 3 Drawing Figures

METHOD OF REMOVING EXHAUST GASES FROM PLASTIC BINDED SAND MOLDS

SUMMARY OF THE INVENTION

The present invention is directed to the treatment of exhaust gases formed in a casting operation where the molds are formed of plastic-bonded sands and, more particularly, it concerns the arrangement for collecting the gases, mixing them with combustion air and igniting the mixture.

From the publication "Dust Control in the Foundry Industry", 1967, Prof. Schmidt, pages 376–378, VDI Verlag, it is known that the exhaust gases generated in casting operations where the molds are formed of plastic-bonded sands are partly toxic and malodorous and are discharged into the atmosphere without treatment through enormously high stacks. Further, it is known that there are devices in which the harmful substances can be separated from the exhaust gases by the use of activated carbon. However, the regeneration of activated carbon is cumbersome and very costly. In another known device, the exhaust gases are separated in a prewashing machine, like a Raschig ring tower, venturi tubes or the like, however, the discharge from such machines is unduly enriched by the harmful substances in the exhaust gases and, even in minute quantities, tends to pollute the environment.

The present invention is directed to an arrangement for collecting the exhaust gases generated in the casting of molds formed of plastic-bonded sand and completely eliminating the exhaust gases in a combustion operation with the amount of air required for combustion being kept as small as possible so that effective treatment of the gases is possible.

In accordance with the present invention, the exhaust gases generated from the plastic binder in the molding sand is released due to the heat given off by the melt in the mold, the exhaust gases are collected within an enclosure to which the mold passes, combustion air is added to the enclosure to provide an ignitable mixture and the mixture is ignited by a source located in the enclosure.

The invention also includes the arrangement of the enclosure or collecting device in which the exhaust gases are collected and burnt, with the enclosure being formed to cover at least three sides of molds as they pass from a casting station. Further, the enclosure is arranged to provide air inlet ports and an exhaust conduit and also to include an ignition source for commencing the combustion of the mixture of the exhaust gases and combustion air.

The various features of novelty which characterize the invention are pointed out with particularity in the claims annexed to and forming a part of this specification. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
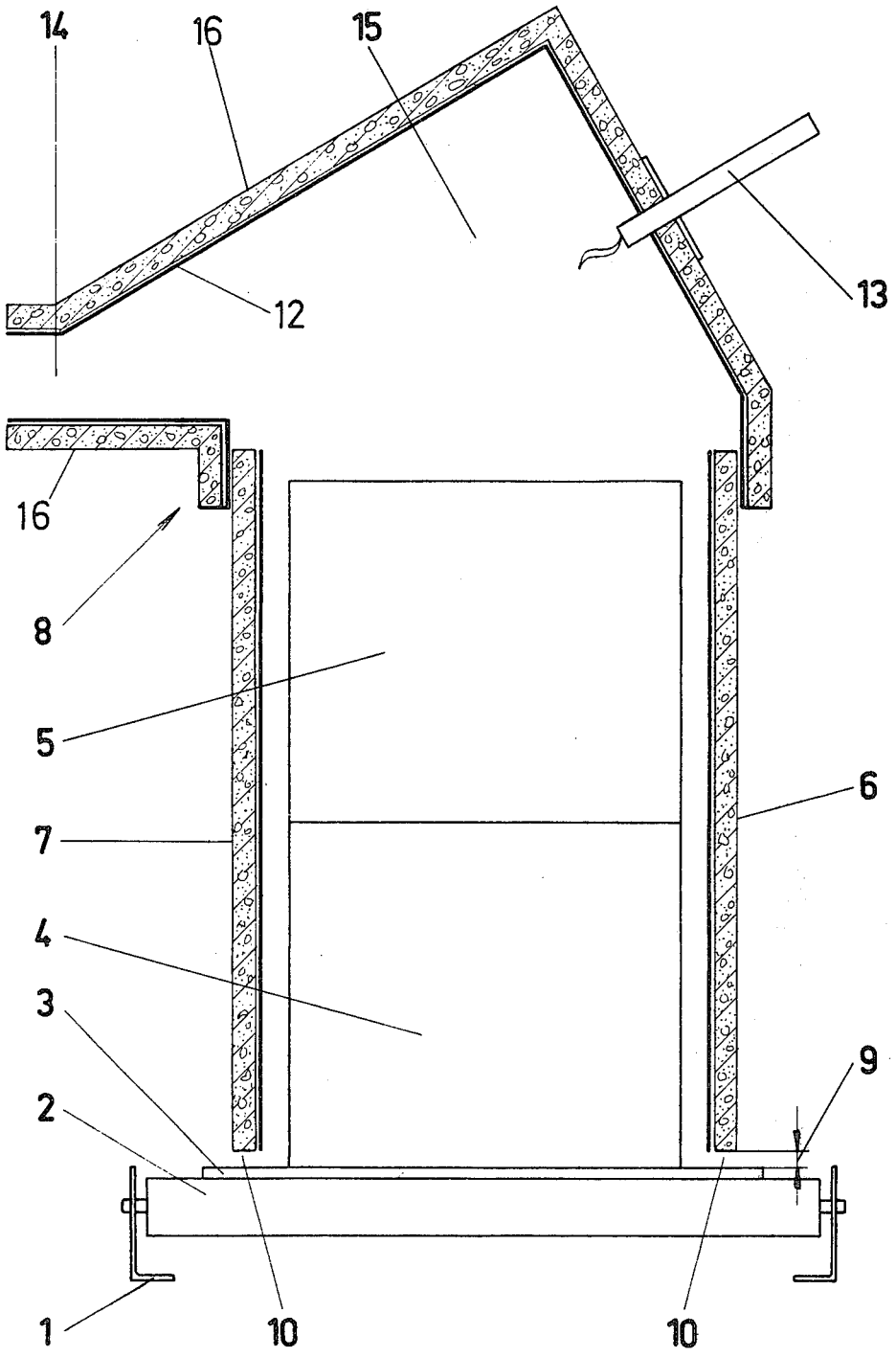
FIG. 1 is a cross sectional view through apparatus embodying the present invention.

In FIG. 1, apparatus is shown for receiving molds 4 and 5 from a casting station. A conveyor 1 including rollers 2 provide a moving support of the molds on plates 3 which extend across the rollers. The molds 4 and 5 can be formed with or without molding boxes. Extending upwardly above the plates 3 are a pair of upwardly extending laterally spaced walls 6 and 7, forming part of an enclosure 8 through which the molds pass. The walls 6, 7 are positioned so that their lower ends are spaced a slight distance 9 above the plates 3, forming inlet ports 10 through which air for supporting combustion can be admitted to the space within the enclosure. It is possible to support the walls 6, 7 so that the spacing or distance 9 of the ports 10 are variable and afford a broad range of control over the supply of combustion air into the enclosure space.

Detachably mounted on the upper ends of the side walls 6, 7 is a hood 12 so that it spans the space above the molds 4, 5. The enclosure 8 forms a tunnel-shaped space through which the molds pass. At least one ignition source 13 is provided along the length of the hood 12 and the ignition source can be, for example, an oxygen fuel gas flame or an electrically produced spark gap for igniting the combination of the exhaust gases generated by the heat of the melt within the mold and the combustion air introduced through the inlet ports 10. While the ignition source is illustrated in the hood 12, it could be arranged at another location within the enclosure, for example, in the side walls. At least one gas exhaust pipe 14 extends outwardly from the hood 12 for removing exhaust gases and is connected to a separating device, not shown, for example, an activated carbon filter or a catalytic after-burner. The hood 12, in combination with the side walls 6, 7, forms a space 15 which serves as a combustion chamber. To prevent the heat generated from the combustion of the exhaust gases from being dissipated, the walls 6, 7 and the hood 12 are provided with a layer of insulation 16 so that the heat can be retained within the space in the enclosure and used for the pre-regeneration of the material used in forming the molds. The length of the enclosure 8 is dimensioned based on the speed of movement of the molds through the enclosure space and the time required for the extensive gasification of the binder portions of the molding sand. As mentioned, the enclosure 8 forms a tunnel-shaped structure or a push-over hood arrangement.

Figure 2:
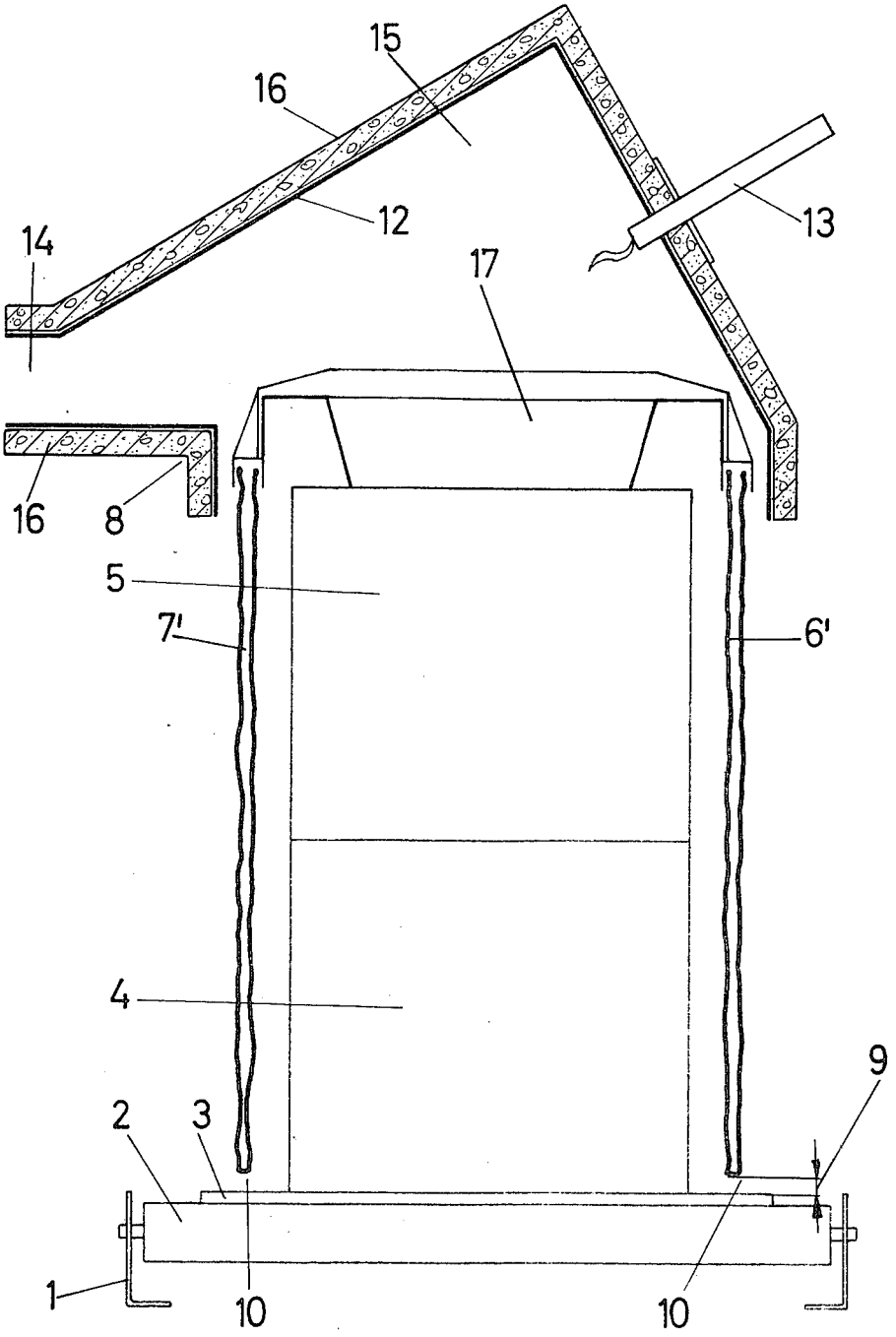
FIG. 2 is a view similar to FIG. 1 of another embodiment of the invention.

To provide a maximum insulating effect for retention of the heat generated in the combustion of the exhaust gases, a highly heat-resistant material with a very low coefficient of heat transmission is used for the insulation 16; further, the enclosure can be built of bricks or it can be variable in its position. To control the flow of combustion air to the inlet ports 10, the side walls 6, 7 are vertically adjustable. It is also possible to arrange the side walls 6 and 7 so that they can be moved separate from the hood, which is mounted in a fixed position. As illustrated in FIG. 2, the side walls ′, 7′ can be connected to the weight 17 for movement with the molds and in such an arrangement the walls 6′, 7′ consist only of an insulating material.

Figure 3:
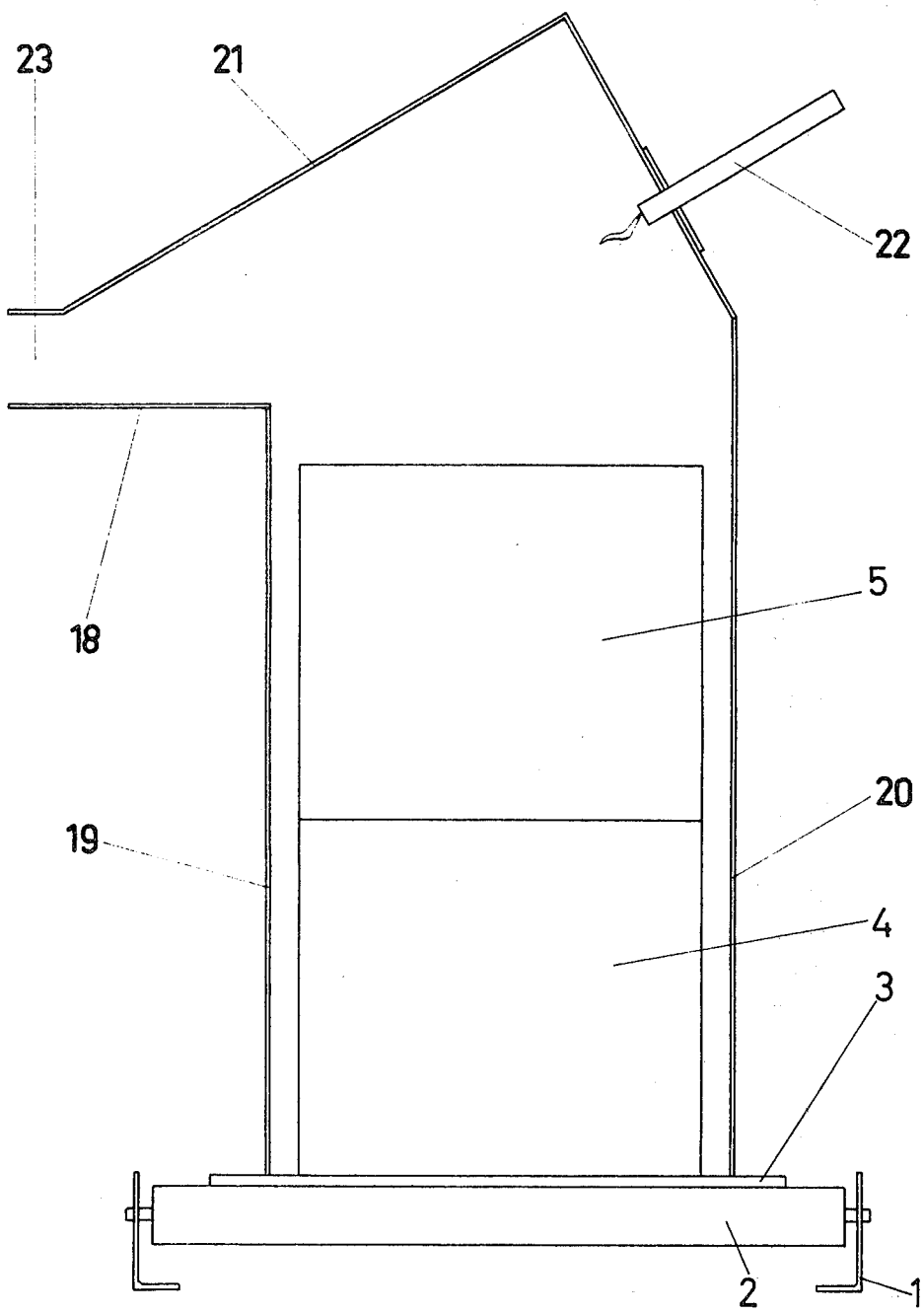
FIG. 3 is yet another cross sectional view, similar to FIGS. 1 and 2, illustrating a further embodiment of the invention.

In the embodiment of the invention shown in FIG. 3, the enclosure 18 is a unitary member which is especially effective in providing a tunnel-shaped space through which the molds pass. The enclosure 18 includes the side walls 19 and 20 and a roof 21 secured to the side walls. An ignition source 22 is mounted in the roof and an exhaust conduit 23 extends outwardly from the roof for connection to exhaust means, not shown. The other parts of the embodiment not specifically mentioned correspond to those illustrated in FIG. 1.

The advantages obtained by utilizing the present invention consist particularly in the relatively small expenditure required for extensive elimination of the harmful substances in the exhaust gases by direct combustion within the enclosure and the amount of exhaust gas corresponds only to a fraction of that in presently used arrangements.

Another advantage of the invention is the utilization of the heat content of the melt and the heat released during the combustion of the exhaust gases to assure that the plastic binder used in combination with the molding sand is degasified to a great extent, with the gases generated being burnt within the enclosure. With such an arrangement, the use of a separating device, for example, an activated carbon filter or a catalytic afterburner, is required in the exhaust outlet from the enclosure only for the small remaining portion of harmful substances which are not removed in the combustion operation. Moreover, a buildup of condensed resin parts on the surfaces of the enclosure over which the exhaust gases flow, is avoided to a very considerable extent and, as a result, maintenance of the plant is reduced to a minimum.

Because of the gasification and combustion of the plastic binder, the unpacking of the molds and the regeneration of the used molding sand are simplified.

While specific embodiments of the invention have been shown and described in detail to illustrate the application of the invention principles, it will be understood that the invention may be embodied otherwise without departing from such principles.

What is claimed is:

1. Method of removing exhaust gases produced from a plastic binder used in molding sands employed for forming casting molds where the exhaust gases are formed by the heat given off from the melt in the mold to the plastic-bonded sand during casting at a casting location, comprising the steps moving the mold from the casting location and during such movement enclosing the mold within a space, collecting the exhaust gases within the enclosing space, adding combustion air into the enclosing space for combination with the exhaust gases for forming an ignitable mixture, and igniting the mixture within the space for the combustion of the exhaust gases therein.

2. Method, as set forth in claim 1, comprising the further step of regulating the amount of combustion air admitted into the enclosing space for controlling the combustion of the mixture of the exhaust gases and combustion air.

3. Method, as set forth in claim 1, comprising the step of removing any unburnt portions of the exhaust gases to a separate space and eliminating the unburnt portions in the separate space by catalytic combustion.

4. Method, as set forth in claim 1, comprising the step of providing a heat insulated construction for the space enclosing the mold for retaining the heat generated within the space by the ignition of the exhaust gases and combustion air for affording pre-regeneration of the material used in forming the mold.

* * * * *